United States Patent [19]

Plume

[11] 4,365,369

[45] Dec. 28, 1982

[54] THREE CUSHION CONVERTIBLE SEAT-BED

[76] Inventor: Robert W. Plume, 11416 Erdmann, Sterling Heights, Mich. 48078

[21] Appl. No.: 176,389

[22] Filed: Aug. 8, 1980

[51] Int. Cl.[3] ..... A47C 17/16

[52] U.S. Cl. ..... 5/38; 5/37 C; 5/47; 5/55 R; 5/57 B

[58] Field of Search ..... 5/18 R, 37 C, 47, 55 R, 5/167, 38, 41, 48, 51 K; 297/92, 342, 65, 379, 111, 114

[56] References Cited

U.S. PATENT DOCUMENTS

| | | | |
|---|---|---|---|
| 828,215 | 8/1906 | Kelly | 5/47 |
| 2,656,877 | 10/1953 | Woller | 297/114 |
| 3,807,790 | 4/1974 | Erard | 297/379 |
| 3,844,608 | 10/1974 | Freedman | 5/47 |
| 3,974,529 | 8/1976 | Johnson et al. | 5/18 R |

*Primary Examiner*—Roy D. Frazier
*Assistant Examiner*—Michael F. Trettel
*Attorney, Agent, or Firm*—Reising, Ethington, Barnard, Perry & Brooks

[57] ABSTRACT

A three cushion convertible seat-bed is disclosed. A single seat has first and second panels (12,14) for the seat back and seat bottom mounted on a seat base (10) and a third panel (16) pivotally coupled with the seat back. A conversion mechanism (18) includes a quadrant plate (80) which is pivotally supported on the base (10). The lower part of the seat back is rigidly connected (84,86) with the quadrant plate (80) and the rear edge of the seat bottom is pivotally coupled (124) with the quadrant plate so that the three panels can be unfolded from the seat orientation to a bed orientation. A first set of latches (A, B, D) holds the conversion mechanism (18) in the seat orientation and are released sequentially by moving an operating handle (22) in one direction. This same motion of the operating handle (22) causes an actuating means (172,170) to thrust the third panel (16) rearwardly toward the bed orientation as the first and second panels (12,14) are unfolded. The quadrant plate (80) pivots during unfolding and shifts the panels forwardly in the bed orientation to reduce the space required rearwardly of the seat. When the panels reach the bed orientation, a second set of latches (C,E) are latched to hold the mechanism (18) in the bed orientation and to provide stiffening of the structure. To convert from bed to seat orientation, the operating handle (22) is moved in the same direction and the operator pulls on a strap (76) near the juncture of the second and third panels (14,16). The movement of the operating handle (22) unlatches the second set of latches (C,E) sequentially and the second panel (14) is pulled toward an erect position. This rotates the quadrant plate (80) and pulls the front panel (12) downwardly and to the rear and causes the third panel (16) to swing forwardly. This action causes the first set of latches (A,B,D) to relatch and hold the mechanism (80) in the seat orientation.

21 Claims, 8 Drawing Figures

THREE CUSHION CONVERTIBLE SEAT-BED

FIELD OF THE INVENTION

This invention relates to seating apparatus of the type which is convertible from a seat to a bed; more particularly it relates to a convertible seat-bed especially adapted for use in recreational vehicles.

BACKGROUND ART

Recreational vehicles, such as vans, are commonly fitted with passenger seating apparatus which is convertible into a bed. It is desirable, of course, to provide a seat and a bed affording utility and comfort which are not compromised by reason of the convertibility between the seat and bed orientations. It is also desirable to provide for conversion between the seat and bed orientations by simple manipulation requiring a minimum of manual effort. Further, such seating apparatus must meet the current governmental safety regulation which impose stringent standards regarding strength and stiffness. Also, the weight of the seating apparatus must be held to a minimum.

With the advent of down-sized vehicles, the prior art convertible seaating apparatus does not satisfy the needs and desires enumerated above. In my U.S. Pat. No. 3,887,229 granted June 3, 1975 for "Convertible Seat", seating apparatus is disclosed which is convertible between seat and bed orientations. However, the seating apparatus of that patent comprises two separate seats which coact with each other when unfolded to form one bed. Although the manual manipulation requires little effort and the operation is relatively simple, the single operating lever does require both forward and rearward actuation sequentially to change from seat to bed orientation.

I have heretofore constructed a single seat so that it is convertible to a bed. In particular, a single seat was constructed in accordance with my U.S. Pat. No. 3,887,229 and provided with a third cushion hingedly mounted on the seat back. The seat of this construction was converted to a bed by unfolding the seat back and bottom, in the manner described in the aforementioned patent, and also unfolding the third cushion so that all cushions were disposed horizontally. The rear edge of the third cushion support member was supported by a pair of cleats mounted on the rear door panel of the van. This arrangement required the operator to manipulate the operating lever to move the seat bottom forward and the seat back downward and then walk around and lift the third cushion into the horizontal position.

A general object of this invention is to provide convertible seat-bed apparatus which is especially adapted to meet the requirements of the new small van vehicles and to do so without the attendant disadvantages of the prior art seating apparatus.

SUMMARY OF THE INVENTION

In accordance with this invention, a single seat is provided which is convertible into a bed. This is accomplished by a seat having first and second panels for the seat bottom and seat back and a third panel which is pivotally coupled with the seat back. Latching means secure the panels relative to the base and a manually actuable means is provided to operate the latching means. The manually actuable means coacts with actuating means on the third panel for unfolding it from the second panel when the manual means is actuated for converting from seat orientation to bed orientation. Further, the third panel is provided with at least one leg depending therefrom and adapted to facilitate the movement of the third panel from its folded position to the extended position in the bed orientation.

Further, in accordance with this invention, a three panel convertible seat-bed is provided in which the first panel, which forms the seat bottom, is shifted forwardly and the second and third panels are unfolded from the first panel in converting from seat to bed orientation. The shifting movement is accomplished by an arrangement including a quadrant plate pivotally mounted on the seat base, preferably by a support arm which extends above the bed level. The first panel is pivotally mounted at its rear edge on the quadrant plate and the second panel is rigidly mounted at its front edge on the quadrant plate with the pivot axis of the first panel and the front edge of the second panel being offset from the pivot axis of the quadrant plate with the panels in the seat orientation. The front edge of the first panel is supported on carrier means for traverse fore and aft. Unfolding of the second panel causes rotation of the quadrant plate about its pivot axis and the front panel is shifted forwardly with the second and third panels coupled thereto through the quadrant plate.

Further, according to this invention, a convertible seat-bed is provided wherein only a single lever movement is required for initiating unfolding from seat to bed orientation and the same single lever movement is required for initiating folding from the bed to seat orientation. This is accomplished by an arrangement wherein first and second latches secure the first and second panels relative to the base in the seat orientation and a third latch secures the first and second panels relative to the base in the bed orientation. The lever operates a shaft with actuating means thereon for unlatching the first and second latches when the lever is rotated in one direction to convert from the seat to bed orientation. The shaft also includes actuating means for unlatching the third latch when rotated in said one direction for converting from bed to seat orientation.

Further, in accordance with this invention, a convertible seat-bed having forward traverse during conversion from seat to bed orientation is provided with a high degree of stiffness in both orientations without need for unduly heavy structural members. This is accomplished by latching the first panel, which is the seat bottom, to the base in the seat orientation and by locking the first panel to the base in the bed orientation.

A more complete understanding of this invention may be obtained from the detailed description which follows taken with the accompanying drawings.

BEST MODE FOR CARRYING OUT THE INVENTION

Figure 1:
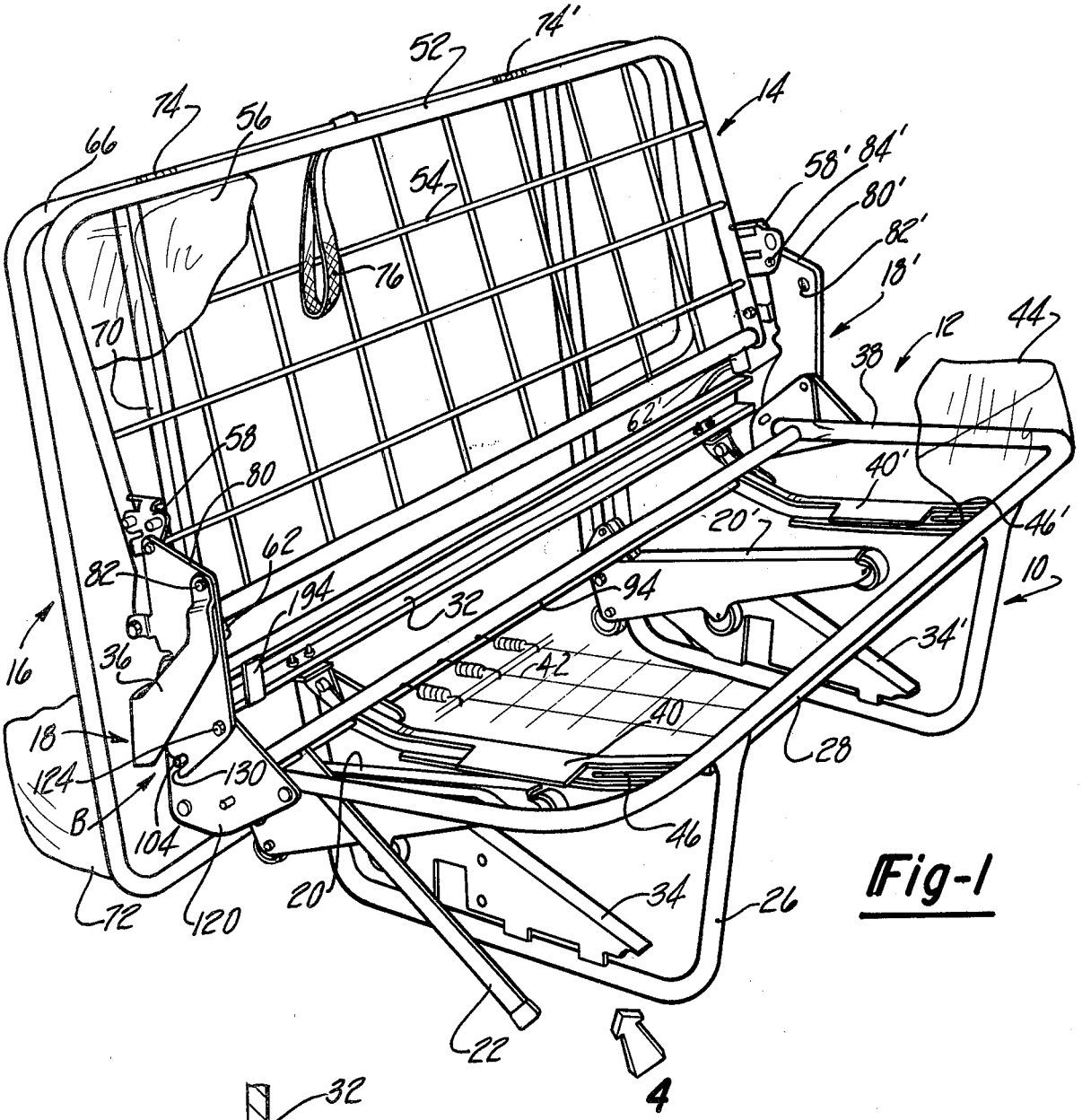
FIG. 1 shows the convertible seat-bed in the seat orientation.

Referring now to the drawings, there is shown an illustrative embodiment of the invention in a convertible seat-bed especially adapted for use in a small van vehicle. It will be appreciated, however, as the description proceeds that the invention is useful in many different applications.

Figure 3:
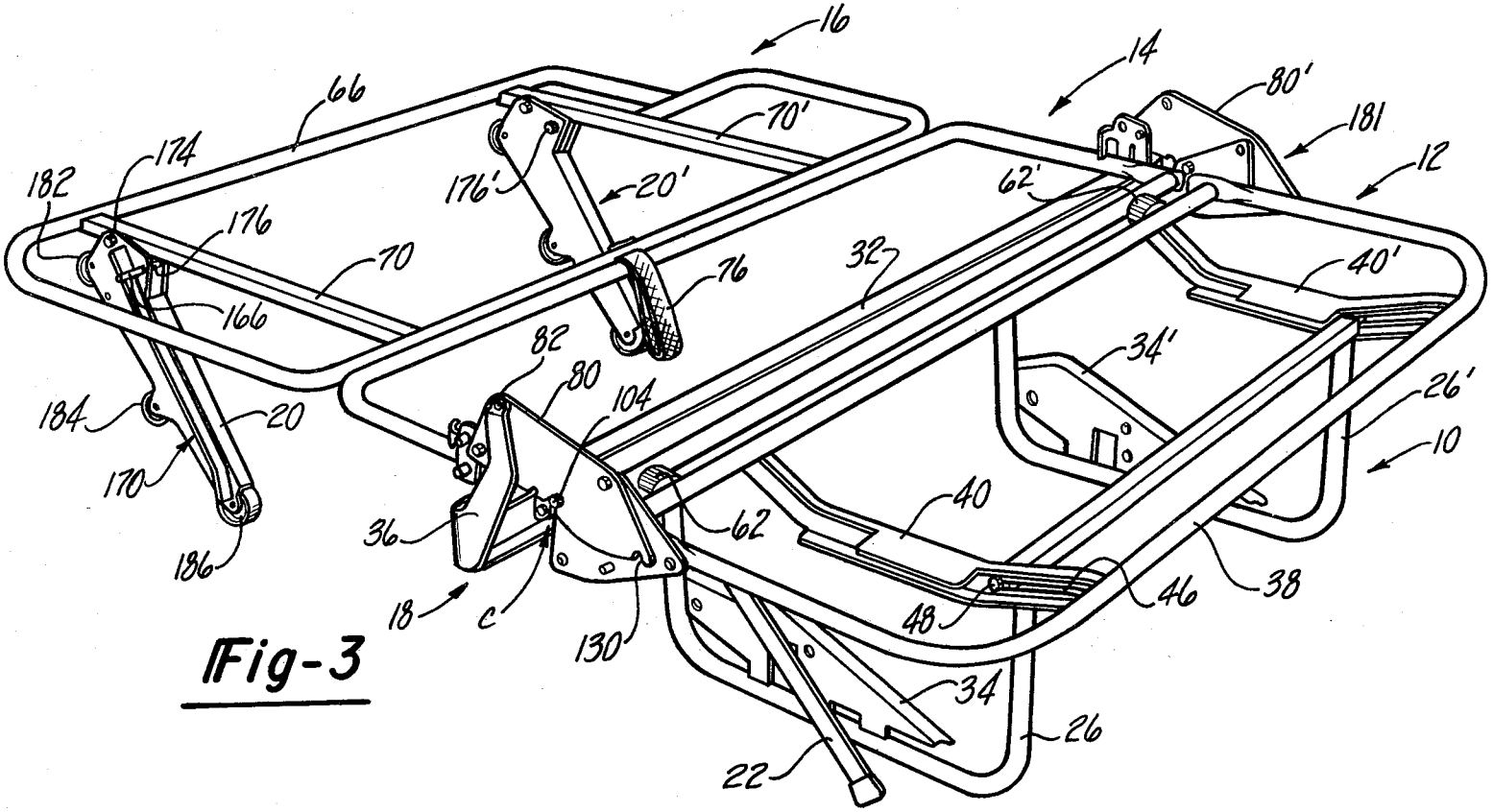
FIG. 3 shows the seat-bed in the bed orientation.

Referring to FIG. 1, the convertible seat-bed is shown in the seat orientation. It comprises, in general, a seat base 10 which is fixedly mounted to the vehicle floor by a suitable means, not shown. A first panel 12 constitutes the seat bottom and is movably supported by the base 10. A second panel 14 constitutes the seat back and is also movably supported by the seat base. A third panel 16 is pivotally supported by the second panel 14; it serves as a rear face of the seat back in the seat orientation and as a bed panel in the bed orientation. A conversion mechanism, comprising right hand mechanism 18 and left hand mechanism 18', interconnects the first, second and third panels relative to the base. The mechanisms 18 and 18' are manually operative to unfold the panels from the seat orientation to the bed orientation and vice versa. FIG. 3 depicts the seat-bed in the bed orientation. In this orientation, the first, second and third panels 12, 14 and 16 are all disposed in the same horizontal plane. The first and second panels are supported entirely by the base 10 and the third panel 16 is supported by a pair of legs 20 and 20'. An operating handle 22 comprises a part of the right hand conversion mechanism 18 and is manually actuated to effect conversion from the seat to bed orientation and vice versa.

Before proceeding with the description of the conversion mechanism, the structure of the base 10 and the first, second and third panels 12, 14 and 16, respectively, will be described. The base 10 is a rigid frame comprising a pair of legs 26 and 26' each of which is U-shaped with the horizontal portion thereof affixed to the floor of the vehicle. The legs 26 are suitably constructed of round steel tubing. A front cross beam 28 of square tubing extends between the upper ends of the front portions of legs 26 and 26' and is bolted thereto. A rear cross beam 32 in the form of a steel channel extends between the upper ends of the rear portion of legs 26 and 26'. The cross beam 32 is secured to the leg 26 by means of a bolt extending through the beam and a flattened end of the leg portion 26 (see FIG. 6). The cross beam 32 is connected with the leg 26' in the same manner. The base also comprises a reinforing plate 34 of triangular shape mounted in the U-shaped leg 26 and a reinforcing plate 34' mounted in the U-shaped leg 26'. The base also includes a pair of support arms 36 and 36' which are mounted by bolts on the cross beam 32 at opposite ends thereof. The support arms extend verticaly above the plane of the panels in the bed orientation and will be described further below.

The first panel 12 comprises a support member or frame 38 which is a rectangular frame made of round steel tubing. The support frame 38 includes a pair of carriage plates 40 and 40' extending fore and aft between the front and rear edges of the support frame 38 and secured thereto by bolts, not shown. The support frame 38 is provided with a set of springs 42. A cushion 44 is mounted upon and secured to the frame and serves as a seat bottom cushion in the seat orientation and a bed cushion in the bed orientation. The front edge of the first panel 12 is mounted for translational movement in the fore and aft direction upon the base 10. As shown in FIG. 3, the carriage plates 40 and 40' define slots 46 and 46' which are inclined relative to the plane of the support member 38. The carriage plate 40 is supported upon the cross beam 28 by a headed pin 48 secured to the beam and extending through the slot 46. The carriage plate 46' is supported on the beam 28 in the same manner. The rear edge of the support frame 38 is supported by the right hand conversion mechanism 18 and the left hand conversion mechanism 18' in a manner that will be described subsequently.

The second panel 14, which constitutes the seat back in the seat orientation, is best shown in FIG. 1. Panel 14 comprises a support member or frame 52 which is a rectangular frame constructed of round steel tubing. A grid 54 of welded steel wire spans the opening within the support frame 52. A cushion 56 is mounted upon and secured to the frame 52 to provide a seat back cushion in the seat orientation and a bed cushion in the bed orientation. The lower edge of the panel 14 (see FIG. 1) at the right-hand side of the seat is mounted upon the conversion mechanism 18 and at the left-hand side is mounted upon the conversion mechanism 18'. For this purpose, a mounting bracket 58 is fixedly mounted, as by welding, on the right-hand side portion 58 of the support frame 52. Also, a horizontally extending stud 60 is mounted, as by welding, below the bracket 58 on the support frame 52. (See also FIG. 4 for bracket 58 and stud 60.) Similarly, a corresponding bracket 58' and stud (not shown) are provided on the left-hand side portion of the support frame 52. The support brackets 58 and 58' are adapted to support arm rests (not shown) for use in the seat orientation. The panel 14 is mounted on a quadrant plate 80 of the conversion mechanism 18 by the bracket 58 and stud 60 in a manner which will be described subsequently. The panel 14 is mounted at the left-hand side in a similar manner. A pair of resilient compression members, in the form of cylindrical rubber blocks 62 and 62', are mounted on the lower edge of the support frame 52, for purposes which will be described subsequently.

Figure 2:
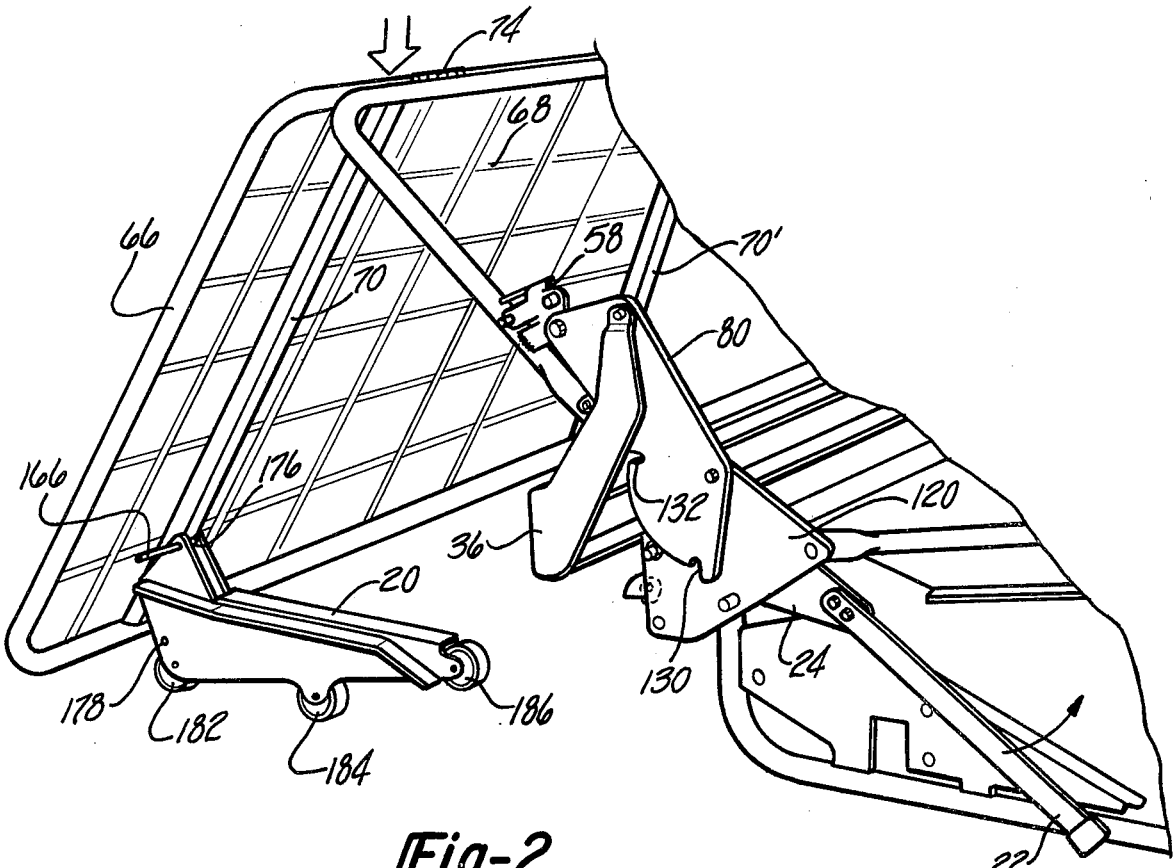
FIG. 2 shows the seat-bed in an intermediate position between the seat orientation and bed orientation.

The panel 16 comprises a support member or frame 66 which is constructed of round steel tubing and is generally of rectangular configuration. As shown in FIG. 3, the panel 16 has an inset portion or notched perimeter at the left rear corner for the purposes of avoiding interference with certain interior structure of the van vehicle. The support frame 66 also includes a pair of beams 70 and 70' which extend fore and aft within the frame and which are secured to the front and rear edges thereof, as by welding. The support frame 66, as shown in FIG. 2, is spanned by a welded wire grid 68. The panel 16 also includes a cushion 72 (see FIG. 1) which is supported by and secured to the support frame 66. The upper or forward edge of the frame 66 is pivotally coupled with the upper or rearward edge of the frame 52 by a pair of hinges 74 and 74'. The cushion 72 serves as the rear face of the seat back when in the seat orientation and serves as a bed cushion when in the bed orientation. A pull strap 76 is secured to the upper or forward edge of the frame 66 and extends between the cushions 72 and 56 for purposes which will be described subsequently. The legs 20 and 20' are supported on the beams 70 and 70', in a manner which will be described subsequently.

Before the right-hand conversion mechanism 18 and left-hand conversion mechanism 18' are described in detail, it will be helpful to consider the general arrangement of the latches which secure the panels in the seat orientation and in the bed orientation. In the seat orientation, the first panel 12 is secured to the base 10 by a first latch A (see FIGS. 6 and 7). In this orientation, the second panel 14 is secured, through a quadrant plate 80, to the first panel by a second latch B (see FIGS. 1 and 5). Additionally, in the seat orientation, the third panel 16 is secured to the first panel 12 by a latch D (see FIG. 5). When latches A, B and D are released, the panels may be unfolded into the bed orientation shown in FIG. 3. When the panels are unfolded to the bed orientation, the second panel 14 is secured, through the quadrant plate 80, to the first panel by a third latch C (see FIGS. 3 and 8) which is automatically latched. Also, the first panel 12 is secured relative to the base 10 by a fifth latch E (see FIG. 8) which is automatically latched. When latches C and E are released the panels may be folded into the seat configuration and the latches A, B and D are automatically latched.

The right-hand conversion mechanism 18 and left-hand conversion mechanism 18' will now be described. With certain exceptions, these mechanisms are mirror images of each other and only the right-hand conversion mechanism 18 will be described explicitly. Corresponding parts in the left-hand conversion mechanism will be designated by the same reference characters with a prime symbol added thereto.

Figure 4:
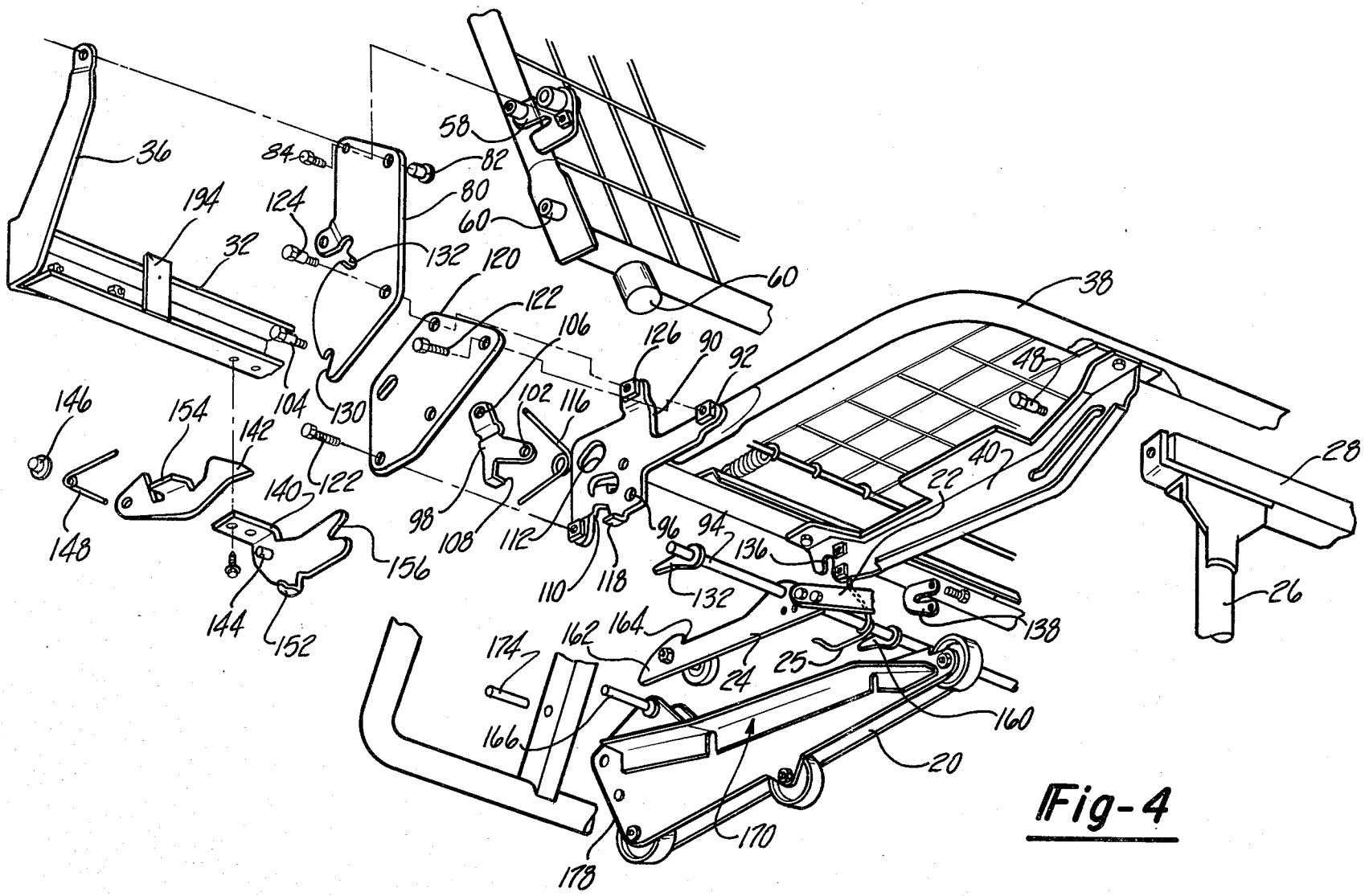
FIG. 4 is an exploded view looking in the direction of the arrow 4 of FIG. 1 to show the individual parts with the seat-bed in the seat orientation.

The right-hand conversion mechanism comprises a quadrant plate 80 which is pivotally mounted on the support arm 36 by a pivot pin 82 (see FIGS. 1, 3 and 4). The second panel 14 is rigidly affixed to the quadrant plate 80 by a bolt 84 extending through the plate into the mounting bracket 58 and by a bolt 86 extending through the quadrant plate into the stud 60. In order to support the first panel 12 on the mechanism 18 a latch plate 90 (see FIGS. 4 and 6) is rigidly attached by welding and by a bolt 92 to the support frame 38 of the panel 12. The latch plate 90, and hence the first panel 12, is supported by the quadrant plate 80 and the quadrant plate is latched to the latch plate 90 by the second latch B, in a manner to be described. The latch plate 90 supports and operating shaft 94 which is rotatably mounted in a circular opening 96 in the latch plate. The operating shaft 94 is rotatable by means of an actuator or operating lever 24 which in turn, is actuated by the operating handle 22 bolted to the lever. The operating lever 24 is biased toward counterclockwise rotation by a coil spring 25 (see FIG. 4) which is mounted on the operating shaft 94. The coil spring 25 has one free end seated on the rear portion of the rectangular frame 38 and the other free end seated in an opening in the operating lever 24. A latch lever 98 is rotatably mounted on the operating shaft 94 which extends through an opening 102 in one arm of the latch lever. The latch lever 98 carries a latch pin 104 which takes the form of a bolt with a threaded shank extending through an opening 106 in the lever 98 and secured thereto by a nut. The latch lever 98 is formed with a foot 108 which extends perpendicularly to the plane of the lever and through a notch 110 formed in the lower portion of the latch plate 90. The latch plate is formed with an oblong opening 112 to accommodate the nut on the end of the pin 104 and to allow limited pivotal motion of the latch lever 98 around the axis of the operating shaft 94. The latch lever 98 is spring-biased for rotation in a clockwise direction (as viewed from the right end of the shaft 94) by a coil spring 116. The coil spring is disposed over the shaft 94 and has one free end seated against a foot 118 on the latch plate 90 and the other free end engaging the bottom of the foot 108 on the latch lever 98. A cover plate 120 is disposed over the latch lever 98 and secured to the latch plate 90 by a pair of threaded fasteners 122.

The latch plate 90 is pivotally mounted on the quadrant plate 80 by a pivot pin 124 which extends through a circular opening in the cover plate 120 and threadedly engages a nut 126 on the latch plate 90. It is noted that the pivot axis of the first panel is defined by the pivot pin 124 through the quadrant plate 80 and is offset forwardly from the pivot axis of the quadrant plate which is defined by the pivot pin 82 through the support arm 36. It is also noted that the front edge of the second panel 14 is offset rearwardly from the pivot axis of the quadrant plate as defined by the pivot pin 82.

When the panels are in the seat orientation, as shown in FIG. 1, the latch B secures the second panel 14, through the quadrant plate 80, to the first panel 12. In the latched condition, the quadrant plate 80 is latched to the latch plate 90 in a first position by the latch pin 104, which is seated in a notch 130 in the forward end of the quadrant plate 80. The operating shaft 94, which is rotatable by the operating lever 22, carries a cam 132 which coacts with the foot 108 on the latch lever 98. When the operating lever 24 is rotated in a counterclockwise direction (as viewed from the right-hand end of the seat) the cam 132 engages the foot 108 and the latch lever 98 is rotated in a counterclockwise direction against the bias of spring 116. This rotation of the latch lever 98 moves the latch pin 104 out of the notch 130 and unlatches the quadrant plate 80 from the latch plate 90. This allows unfolding of the panels to the bed orientation, subject, however, to the unlatching of the first latch A, and the fourth latch D, which will be described subsequently.

The latch C, as shown in FIG. 3, secures the second panel 14, through the quadrant plate 80, to the first panel 12. The latch C comprises the latch lever 98 and a second notch 132 in the quadrant plate 80, near the mid-portion thereof. When the second panel 14 is unfolded, the spring bias on latch lever 98 causes the latch pin 104 to enter the notch 132 to latch the quadrant plate 80 to the latch plate 90. When the operating lever 24 is rotated in a counterclockwise direction (as viewed from the right-hand end of the seat) the cam 132 engages the foot 108 and the latch lever 98 is rotated to move the pin 104 out of the notch 132 to unlatch the quadrant plate from the latch plate.

Figure 7:
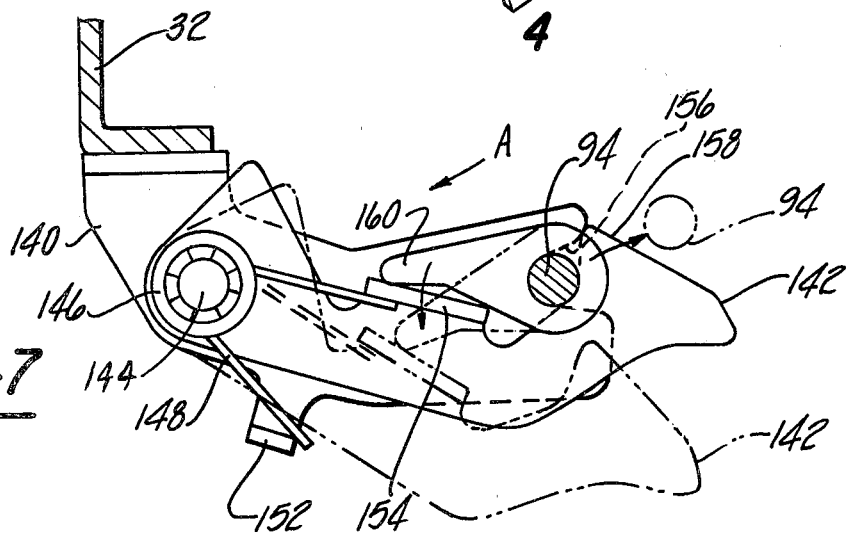
FIG. 7 is a view taken on lines 7—7 of FIG. 6.
Figure 6:
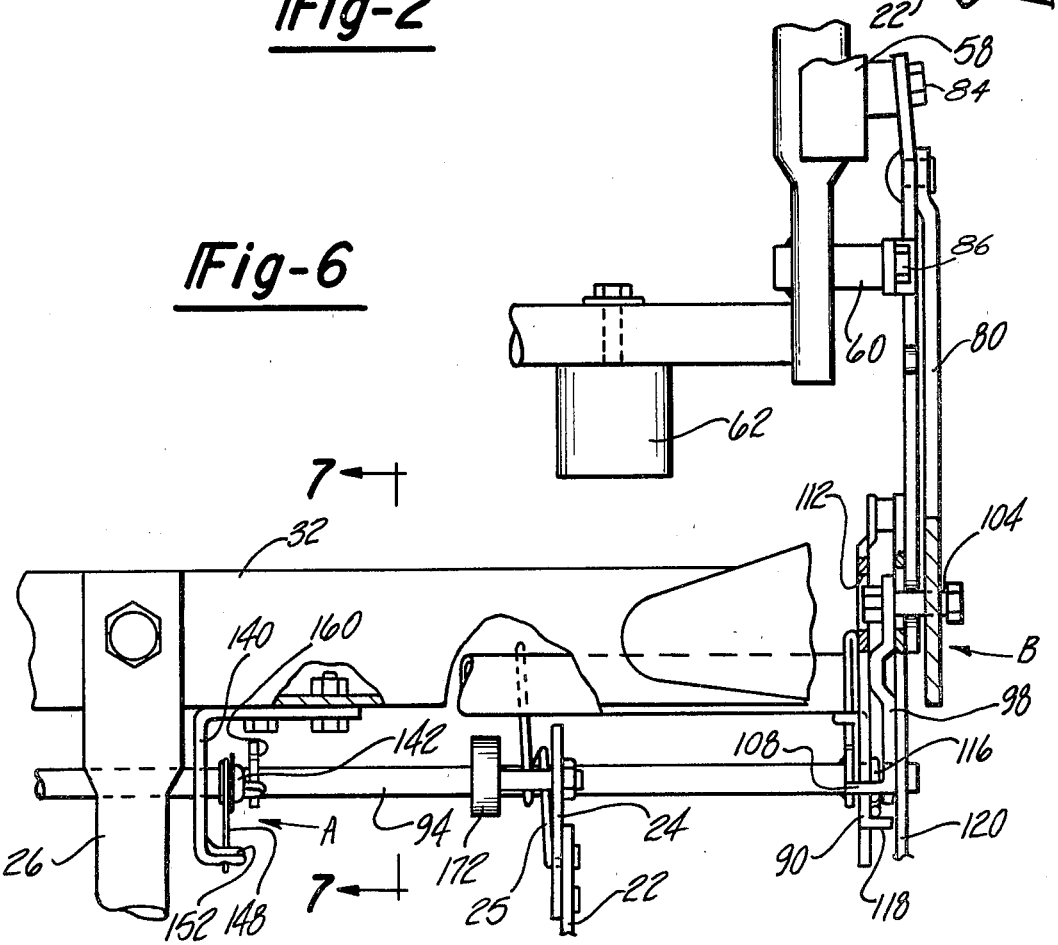
FIG. 6 is a view taken on lines 6—6 of FIG. 5.

As described above, the first panel 12 is secured to the base 10 by the first latch A, which is best shown in FIGS. 6 and 7. Before describing latch A, however, it is noted that the operating shaft 94 is pivotally supported in the rear end of the fore and aft carriage plate 40 which forms part of support frame 38. As shown in FIG. 4, a circular notch 136 is provided in the end of plate 40 to accept the shaft 94. The shaft is retained in the notch 36 by a U-shaped retaining member 138 which is bolted onto the plate 40. In a similar manner the shaft 94 is rotatably supported in the rear end of the beam 40'.

The latch A, as shown in FIGS. 4, 6 and 7, secures the operating shaft 94, and hence the first panel 12, to the cross beam 32 of the base 10. For this purpose, a latch bracket 140 is bolted to the beam 32 and a latch lever 142 is pivotally mounted thereon by a pivot pin 144 which is held by a speed-nut 146. The latch lever is biased toward rotation in the counterclockwise direction (as viewed in FIG. 7) by a coil spring 148. The spring 148 has one free end seated against a foot 152 on the bracket 140 and the other free end pressing against a foot 154 on the latch lever 142. The outer end of the latch bracket 140 defines a U-shaped notch 156 which receives the operating shaft 94 when the first panel 12 is in the rearward position corresponding to the seat orientation. The latch lever 142 has a nose portion 158 which engages the operating shaft 194 and traps it in the notch 156 when the latch lever is in its upper position. A cam 160 is mounted on the operating shaft 194 for actuation of the latch lever 142. The cam 160 engages the foot 154 on the latch lever 142 and rotates the lever downwardly when the operating shaft is rotated in a counterclockwise direction (as viewed from the right hand end of the seat). This rotation unlatches the first latch A and releases a first panel 12 from the base 10 to allow unfolding of the panels into the bed orientation, provided that the second latch B, as described above, is unlatched and provided that the fourth latch D which will be described presently, is also unlatched.

Figure 5:
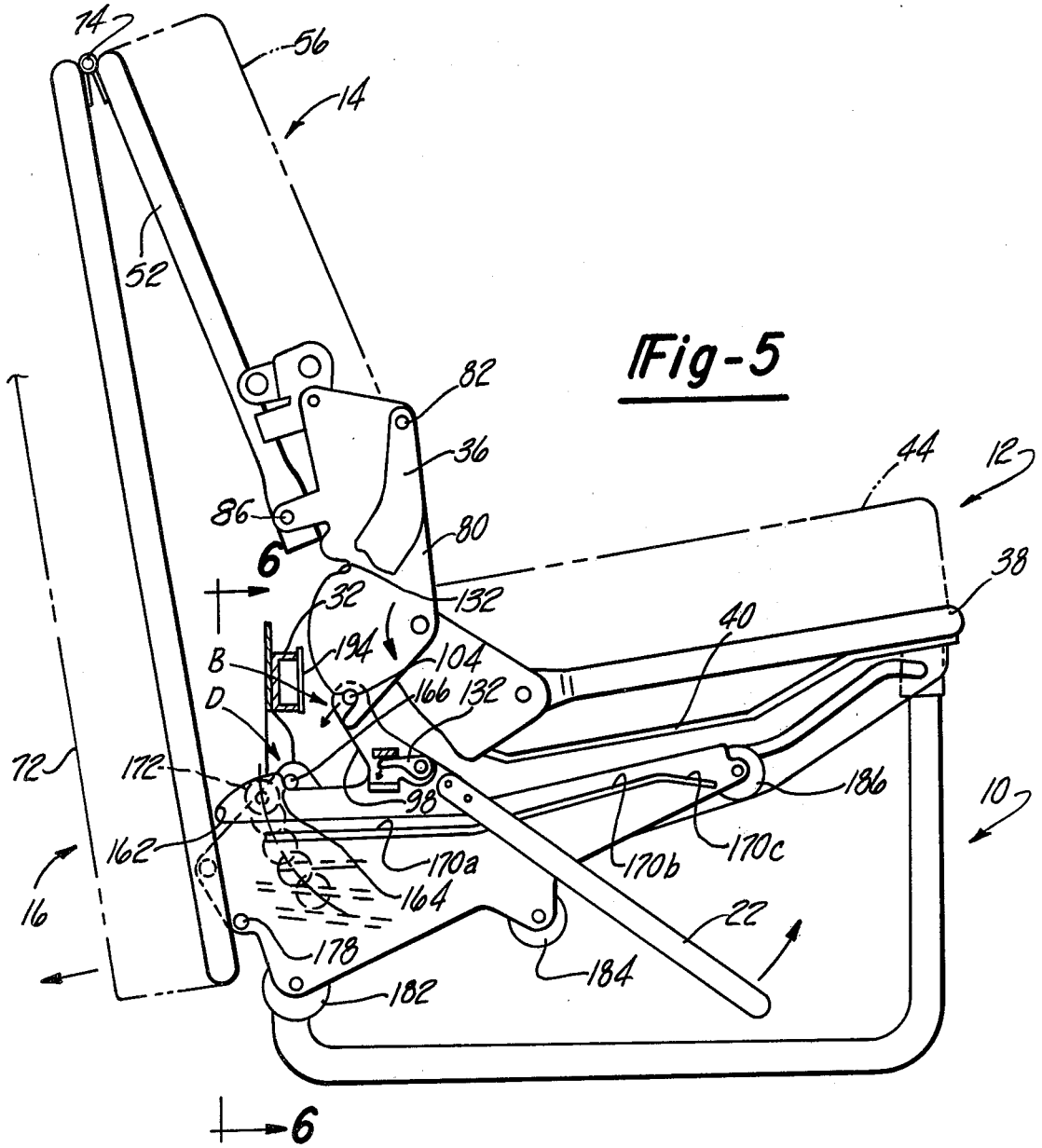
FIG. 5 is an end view with parts broken away to illustrate the unlatching for conversion from seat to bed orientation.

As mentioned above, the fourth latch D secures the third panel 16 to the first panel 12 when the panels are in the seat orientation, as shown in FIG. 1 and FIG. 5. The fourth latch D comprises a portion of the operating lever 24 which is actuated by the handle 22. The lever 24 extends rearwardly from the operating shaft 94 and terminates in a nose portion 162. The operating lever 24 constitutes a latch pawl having a recess or hook 164 at the rear of the nose portion 162. A latch pin 166 is mounted on the leg 20 (see FIGS. 3 and 5). With the panels in the seat orientation, as shown in FIG. 5, the hook 164 on the operating lever 24 engages the latch pin 166 and secures the third panel to the first panel through the operating lever 24 and the operating shaft 94. The latch D is unlatched by rotation of the operating handle 22 in a counterclockwise direction, as viewed in FIG. 5. The latch D is automatically latched when the panels are folded from the bed orientation to the seat orientation. When the latch D is unlatched, the third panel 16 may be unfolded to the bed orientation, provided that the first latch A and the second latch B are unlatched, as described above.

For the purpose of converting from the seat orientation to the bed orientation, the fourth latch D, first latch A and second latch B are unlatched in the sequence named for purposes which will become apparent as the description proceeds. For this purpose, the hook 164 of latch D is adapted to clear the latch pin 166 during the first increment of rotation of the operating handle 22 from its rest position. After this first increment of motion, the third panel 16 is free to rotate about the hinges 74 and 74' to an unfolded position. During a second increment of rotation of the operating handle 22 there is a lost motion of the operating shaft 94 resulting from an angular spacing between the cam 160 and latch lever 142 of the first latch A and between the cam 132 and latch lever 98 of the second latch B. During this lost motion of the operating shaft 94 in the unlatching sequence, the third panel 16 is propelled rearwardly in an unfolding motion toward the bed orientation, by means which will be described presently. During a third increment of motion of the operating handle 22, the cam 160 displaces the latch lever 142 to unlatch the first latch A and release the first panel 12 from the base 10. This permits forward motion of the first panel 12 by traverse thereof on the carriage plates 40 and 40', in a manner which will be described subsequently. During a fourth increment of motion of the operating handle 22, the latch cam 132 engages the latch lever 98 and unlatches the second latch B. This releases the quadrant plate 80 from the latch plate 90 and allows the quadrant plate 80 to rotate about the pivot pin 82 in the support arm 36. This rotation of the quadrant plate 80 is augmented by the downward motion of the second panel 14, which is supported to the rear of the pivot pin 82. This rotation of the quadrant plate 80 in the counterclockwise direction (as viewed in FIG. 1) causes a forward and upward motion of the first panel 12. The complete motion of the panels 12, 14 and 16 will be described after further description of the above-mentioned means for propelling the third panel 16 rearwardly to unfold the same.

In order to initiate the unfolding action of the third panel 16 from the second panel 14, actuating means are provided to coact with the operating lever 24. For this purpose, a cam track 170 is mounted on the leg 20. The cam track 170 is suitably formed by an angle iron with one side bolted to the leg 20 and the other side disposed horizontally to form the surface of the cam track. It is noted, as shown in FIG. 5, that the cam track 170 has three surface segments **170*a*, 170*b* and 170*c* which are inclined at different angles relative to the horizontal. A cam roller 172 is rotatably mounted on the nose 162 of the operating lever 24 (see FIGS. 4 and 5). The cam roller 172 rests just above the cam track 170 when the panels are latched in the seat orientation, as shown in FIG. 5. The leg 20 is pivotally mounted on the beam 70 by a pivot pin 174, as best shown in FIG. 3. The leg 20 is referred to as a "floppy" leg because of the pivotal mounting. The pivotal motion of the leg is limited in the upward direction by a stop pin 176 of which the latch pin 166 is a extension. The pivotal motion of the leg in the downward direction is limited by a stop pin 178 (see FIG. 5). The leg 20 is provided with a set of three rollers 182, 184 and 186 which serve to carry the third panel 16 to its unfolded position for the bed orientation. With the leg 20 disposed as shown in FIG. 5 in the seat orientation, the rollers 182, 184 and 186 are located on the lower edge of the leg 20. The leg 20' is of the same construction as the leg 20 except that it does not carry a cam track or latch pin corresponding to cam track 170 and latch pin 166**.

When the operating handle 22 is rotated in the counterclockwise direction to convert from seat to bed orientation, the latch D is released during the first increment of motion and during the second increment of motion, the cam roller 172 engages the cam track 170 at such an angle that the leg 20, and hence the panel 16, is cammed rearwardly. During this camming action, which thrusts the panel 16 to the rear, the rollers 182, 184 and 186 successively engage the floor and carry the panel 16 in its rearward motion. At the end of the second increment of motion of the operating handle 22, latch A is unlatched and the first panel 12 is released from the base 10 so that it is free to move forwardly on the carriage plates 40 and 40'. After the third increment of motion of the operating handle 22, the second latch B is unlatched and the quadrant plate 80 is free to rotate relative to the first panel 12. Thus, the second panel 14 which is mounted on the quadrant plate unfolds to the horizontal position and is carried forward by the quadrant plate which causes the first panel 12 to move forward. As the first panel moves forward on the tracks 46 and 46' of the carriage plates, the rear edge of the panel is raised by the pivotal action of the quadrant plate 80 and the forward edge of the panel 12 is raised to place it in a horizontal position.

During this unfolding action, the second panel 14 and third panel 16 tend to move toward the horizontal position; with the rollers 182, 184 and 186 on a hard floor surface, the unfolding action will be completed without further manual effort. However, on a carpeted floor, the second and third panels 14 and 16 may come to rest in an inclined position and it will be necessary to press downwardly at the juncture of the panels to position them horizontally. In the final motion of the unfolding action, the compression members 62 and 62' are squeezed between the frames of panels 12 and 14 due to the difference in forward motion of these panels. It is noted that the first, second and fourth latches A, B and D have been described as being actuated sequentially during the first, third and fourth increments of motion of the operating handle 22. It will be appreciated, however, that the second and fourth latches B and D could be operated substantially simultaneously with the same result as described above.

When the seat-bed is converted to the bed orientation, as described above, the quadrant plate 80 is latched to the latch plate 90 by the third latch C. This effectively latches the second panel 14 to the first panel 12. This arrangement is effective to stiffen the structural connection between the first and second panels 12 and 14 without the use of heavy structural members.

Figure 8:
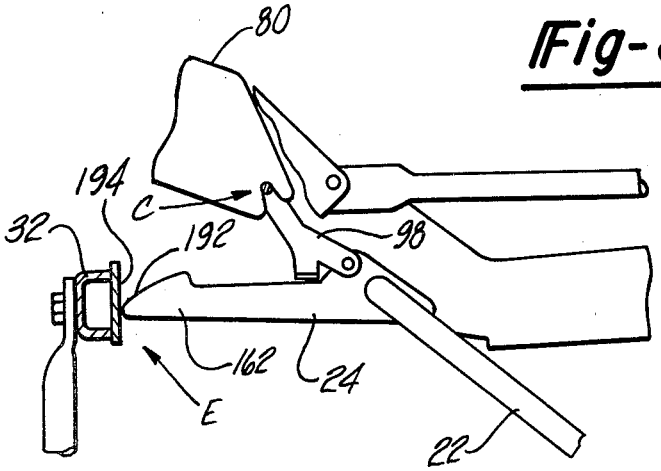
FIG. 8 is an end view of the seat-bed apparatus showing certain structural features in the bed orientation.

In order to provide further stiffening of the bed structure, the fifth latch E is provided. The latch E, as shown in FIG. 8, comprises cam surface 192 which engages a cam plate 194. The cam surface 192 is disposed from the nose 162 of the operating lever 24. The cam plate 194 is mounted on the beam 32, as by welding. (See also FIG. 4). During the final unfolding motion in converting on seat to bed orientation, the cam surface 192 on the operating lever 24 moves upwardly and is cammed against the cam plate 194, as shown in FIG. 8. This camming action tends to push the first panel 12 forwardly relative to the base 10 and adds stiffness to the structural connection thereof.

As stated above, conversion mechanism 18' is the same as conversion mechanism 18, with certain exceptions. The exceptions are as follows: conversion mechanism 18' is not provided with an operating lever corresponding to operating lever 24 and hence there is no latch corresponding to latch D, no latch corresponding to latch E, and no cam roller corresponding to roller 172.

The operation of converting from the seat orientation to the bed orientation will now be summarized briefly, followed by a description of the conversion from the bed to the seat orientation. As described above, the conversion mechanism shifts the panels forwardly relative to the base in the seat to bed conversion. This feature reduces the space required rearwardly of the seat while permitting use of a full size bed. To convert from seat to bed orientation, the operator simply pulls upwardly on the operating handle 22. (See FIGS. 1, 2 and 5). The first increment of upward motion unlatches the fourth latch D by moving the operating lever 24 downwardly. This releases the third panel 16 from the first panel 12. Continued upward motion of the operating handle 22 causes the cam roller 172 to engage the cam track 170, the cam action on the track thrusts the lower edge of the third panel 16 to the rear causing it to unfold relative to the second panel 14. The cam action on the track continues through a second increment of motion of the operating handle 22 at the end thereof, the first latch A (see FIGS. 6 and 7) is unlatched to release the first panel 12 from the base 10. Shortly thereafter, (or if desired, simultaneously) the second latch B (see FIG. 1) is unlatched. This allows the quadrant plate 80, and hence the second panel 14, to pivot rearwardly to unfold the second panel relative to the first panel. This unfolding action is represented in an intermediate state in FIG. 2. In this state the hinged juncture of the second and third panels is moving downwardly, as indicated by the arrow near the hinge 74. The legs 20 and 20' glide rearwardly on the rollers 182, 184 or 186 depending upon the angle of inclination of the second and third panels. The legs 20 and 20' are pivoted against the stop pins 176 and 176', respectively. In case the unfolding action stops before the panels are completely unfolded to the horizontal position, it will be necessary to apply a manual force downwardly in the vicinity of the juncture of the second and third panels. In the final motion of the unfolding action, the third latch C is latched by the seating of the latch pin 104 in the notch 132 on the quadrant plate 80. Also, in the final motion of the unfolding action, the fifth latch E is latched by the upward movement of the cam surface 192 on operating lever 24 against the cam plate 194. Thus, the first and second panels are latched together by the third latch C and the first panel is latched relative to the base 10 by the fifth latch E. This imparts a high degree of stiffness to the bed structure.

To convert from the bed orientation to the seat orientation, the operator simply pulls the operating handle 22 upwardly and then pulls the strap 76 forwardly. When the operating handle 22 is pulled upwardly, the fifth latch E is unlatched during the first increment of motion and the third latch C is unlatched during a second increment of motion. This sequentially releases the first panel 12 from the base 10 and releases the quadrant plate 80, and hence the second panel 14, from the first panel 12. When the third latch C is unlatched, the compressed rubber blocks 62 and 62' push the first and second panels apart sufficiently to initiate folding of the panels. As the second panel 14 is pulled forwardly, it pivots toward an erect position and the quadrant plate 80 is rotated until the second latch B is latched by the entry of the latch pin 104 into the notch 130 on the quadrant plate 80. During this movement of the second panel 14, the first panel 12 is pulled rearwardly and downwardly by the quadrant plate 80. The front edge of the first panel 12 is guided by the slots 46 and 46' in the carriage plates 40 and 40' to the original position and rake of the panel in the seat orientation. During the final motion of the folding action, the first latch A is latched. This results from the rearward motion of the first panel 12 which causes the operating shaft 94 to actuate the latch lever 142 and become seated in the notch 156 of the latch bracket 140. The forward motion of the second panel 14 carries the third panel 16 with it and the momentum thereof causes the third panel to swing downwardly when the forward motion of the second panel is stopped. The swinging motion of the third panel 16 causes latching of the fourth latch D when the latch pin 166 engages the cam surface of the nose 162 of the operating lever 24 and is seated in the notch 164 thereof. It is noted that in this swinging motion of the third panel 16 the legs 20 and 20' are pivoted to a position determined by the lower stop member 178 and 178', respectively. Thus, the panels are latched in the seat orientation and may be returned to the bed orientation as described above.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. In a convertible seat-bed of the type comprising:
a stationary base,
first and second panels pivotally coupled with the base and adapted, respectively, to form a seat bottom and seat back in a seat orientation and to form side-by-side bed panels in a bed orientation,
a third panel pivotally coupled with said second panel and adapted to form a third bed panel in said bed orientation,
latching means for securing said first and second panels relative to the base,
and manually actuable means for operating said latching means,
the improvement including,
said third panel including a leg for carrying the rear edge thereof to the bed orientation,
said manually actuable means comprising an actuator lever for thrusting said third panel rearwardly,
said lever being supported by the base and being operatively engageable with but separate from the third panel whereby the third panel is movable independently of the lever after being thrust rearwardly thereby,
said leg being pivotal relative to the third panel between a first position in the seat orientation and a second position during movement to the bed orientation, different parts of the leg in the second position engaging the floor to support the third panel during movement thereof.

2. The invention as defined in claim 1 including,
a quadrant plate pivotally mounted on said base,
said first panel being pivotally mounted at its rear edge on said quadrant plate and said second panel being rigidly mounted at its front edge on said quadrant plate with the pivot axis of the first panel being offset from the pivot axis of the quadrant plate and the front edge of the second panel being offset from the pivot axis of the quadrant plate with the panels in the seat orientation,
whereby the first and second panels are moved in translational motion in a horizontal plane by pivotal motion of the quadrant plate when converting from seat orientation to bed orientation.

3. The invention as defined in claim 2 wherein,
said latching means includes a first latch for securing the first panel to the base in the seat orientation,
a second latch for securing the quadrant plate in one position to the first panel in the seat orientation,
a third latch for securing the quadrant plate in another position to the first panel in the bed orientation,
said manually actuable means including a shaft,
latch actuating means on said shaft coacting with said first and second latches,
said actuator lever being connected with said shaft for rotation thereof in one direction to unlatch the first and second latches for converting from seat orientation to bed orientation and to unlatch the third latch for converting from bed orientation to seat orientation.

4. The invention as defined in claim 3 including,
a support arm mounted on said base and extending above said first panel,
said quadrant plate being pivotally mounted on said support arm adjacent the upper end thereof and depending therefrom,
support means for the front edge of said first panel adapted to allow fore and aft motion relative to said base,
whereby unlatching of the first and second latches permits pivoting of said quadrant plate on said arm so that said second panel moves downwardly and forwardly and said first panel moves upwardly and forwardly when converting from said seat orientation to bed orientation.

5. The invention as defined in claim 3 including,
a cam disposed on the forward end of said lever,
a cam plate fixedly mounted on said base and adapted to be engaged by said cam when said panels are in the bed orientation to provide stiffening of the connection of the panels to said base.

6. The invention as defined in claim 3 including,
a fourth latch for securing said third panel relative to the base when the panels are in the seat orientation,
said actuator lever coacting with said fourth latch to unlatch it when the lever is rotated in said direction to unlatch the first and second latches.

7. The invention as defined in claim 4 wherein,
said offset of the pivot axis of the first panel and said offset of the front edge of the second panel is such that the second panel moves forwardly more than the first panel,
and resilient means disposed between the first and second panels and adapted to be deformed by the relative motion therebetween during conversion from seat orientation to bed orientation,
whereby energy is stored in said resilient means and said resilient means pushes said first and second panels apart and initiates a folding action when said first and second latches are unlatched.

8. The invention as defined in claim 4 including,
a latch plate fixedly mounted on the first panel adjacent the rear edge thereof,
said shaft being rotatably mounted in said latch plate,
a latch lever pivotally mounted on said latch plate and having a latch element thereon extending transversely of said quadrant plate,
said quadrant plate defining a first latch keeper adapted to receive said latch element with said panels in the seat orientation wherein said second latch comprises said latch element and said first latch keeper,
said quadrant plate defining a second latch keeper adapted to receive said latch element with said panels in the bed orientation.

9. The invention as defined in claim 4 wherein said support means comprises ramp means on said first panel and ramp follower means on said base wherein the height of the front edge of said first panel is changed when it moves forward in converting from seat to bed orientation.

10. The invention as defined in claim 3 wherein,
said first latch comprises, a pivotal latch keeper mounted on said base and adapted to receive a portion of said shaft when said first panel is in the seat orientation.

11. The invention as defined in claim 8 including,
a first cam mounted on said shaft for rotation therewith and adapted to engage said latch lever for unlatching said second and third latches,
a second cam mounted on said shaft for rotation therewith and adapted to engage said pivotal keeper to unlatch the first latch,
whereby rotation of the lever in said direction is operative to unlatch the first and second latches for converting from seat to bed orientation and rotation of the lever in said direction is operative to unlatch the third latch for converting from bed to seat orientation.

12. The invention as defined in claim 1 including,
a cam track disposed on said third panel for receiving said thrust from said lever,
a cam on said lever adapted to engage said cam track when said lever is actuated to convert from seat to bed orientation and thereby thrust said third panel rearwardly to unfold the panels.

13. The invention as defined in claim 12 wherein,
said cam track is disposed on said leg,
and said cam is disposed on the rearward end of said lever.

14. The invention as defined in claim 1 or 13 wherein,
said leg is pivotally mounted on said third panel,
stop means for limiting the pivotal movement of said leg relative to the third panel,
said leg having glide means disposed at spaced intervals along the length of the leg for engaging the floor when said third panel is unfolded or folded relative to said second panel,
whereby the rear edge of said third panel is supported on the floor during movement between the seat and bed orientation.

15. The invention as defined in claim 14 wherein,
said glide means comprises a first roller on the side of the leg adjacent the upper end thereof, a second roller on the side of the leg intermediate the ends thereof and a third roller on the lower end of the leg.

16. The invention as defined in claim 1 including,
a first latch for securing said third panel to the first panel when the panels are in the seat orientation,
a second latch for securing the first panel to the base in the seat orientation,
a third latch for securing the second panel to the first panel in the seat orientation,
said manually actuable means including a shaft,
latch actuating means on said shaft for coaction with said latches,
said actuator lever being connected with said shaft for rotation thereof in one direction to unlatch said latches for converting from seat orientation to bed orientation,
said latch actuating means including first, second and third latch actuating elements mounted on said shaft in a predetermined positional relationship for movement with said shaft and coacting respectively with said first, second and third latches,
said predetermined positional relationship being such that said latches are unlatched in sequence so that the unfolding of the panels starts with the release of said third panel for swinging it away from said second panel.

17. In a convertible seat-bed of the type comprising,
a stationary base,
first and second panels pivotally coupled with the base and adapted, respectively, to form a seat bottom and seat back in a seat orientation and to form side-by-side bed panels in a bed orientation,
a third panel pivotally coupled with said second panel and adapted to form a third bed panel in said bed orientation,
latching means for securing said first and second panels relative to the base,
and manually actuable means for operating said latching means,
the improvement wherein,
said latching means includes first and second latches for securing the first and second panels relative to the base in the seat orientation,
a third latch for securing said first and second panels relative to said base in said bed orientation,
said manually actuable means includes a shaft and an actuator lever thereon for rotation of the shaft,
latch actuating means on said shaft coacting with said first, second and third latches,
said latch actuating means being operative when the actuator lever is rotated in one direction with the panels in the seat orientation to unlatch the first and second latches for converting from seat orientation to bed orientation and being operative when the actuator lever is rotated in said one direction with the panels in the bed orientation to unlatch the third latch for converting from bed to seat orientation.

18. The invention as defined in claim 17 including,
a fourth latch for securing said third panel relative to said base in the seat orientation,
said actuating means on said shaft coacting with said fourth latch to unlatch it when said lever is rotated in said direction for converting from seat to bed orientation.

19. The invention as defined in claim 18 including,
a quadrant plate pivotally mounted on said base,
said first panel being pivotally mounted at its rear edge on said quadrant plate and said second panel being rigidly mounted at its front edge on said quadrant plate with the pivot axis of the first panel being offset from the pivot axis of the quadrant plate and the front edge of the second panel being offset from the pivot axis of the quadrant plate with the panel in the seat orientation,
a latch plate fixedly mounted on the first panel adjacent the rear edge thereof,
said shaft being rotatably mounted in said latch plate,
a latch lever pivotally mounted on said latch plate and having a latch element thereon extending transversely of said quadrant plate,
said quadrant plate defining a first latch keeper adapted to receive said latch element with said panels in the seat orientation wherein said second latch comprises said first latch element and said first latch keeper,
said quadrant plate defining a second latch keeper adapted to receive said latch element with said panels in the bed orientation wherein said third latch comprises said first latch element and said second latch keeper,
said first latch comprising a pivotal latch keeper mounted on said base and adapted to receive a portion of said shaft when said first panel is in the seat orientation, a first cam mounted in said shaft for rotation therewith and adapted to engage said latch lever for unlatching said second and third latches, a second cam mounted on said shaft for rotation therewith and adapted to engage said pivotal keeper to unlatch the first latch, whereby rotation of the actuator lever in said direction is operative to unlatch the first and second latches for converting from seat to bed orientation and rotation of the actuator lever in said direction is operative to unlatch the third latch for converting from bed to seat orientation.

20. In a convertible seat-bed of the type comprising, a stationary base, first and second panels pivotally coupled with the base and adapted, respectively, to form a seat bottom and seat back in a seat orientation and to form side-by-side bed panels in a bed orientation, a third panel pivotally coupled with said second panel and adapted to form a third bed panel in said bed orientation, a first set of latches for securing the panels relative to the base in the seat orientation, a second set of latches for securing the panels relative to the base in the bed orientation, manually actuable means including an actuator lever mounted on the first panel for operating said latches, a cam disposed on said lever, a cam plate fixedly mounted on said base and adapted to be engaged by said cam when said first and second panels are in the bed orientation to provide stiffening of the connection between the panels and the base.

21. The invention as defined in claim 20 including, a quadrant plate pivotally mounted on said base, said first panel being pivotally mounted at its rear edge on said quadrant plate, said second panel being rigidly mounted at its front edge on said quadrant plate, a latch plate fixedly mounted on the first panel adjacent the rear edge thereof, said manually actuable means including a shaft rotatably mounted in said latch plate, a latch lever pivotally mounted on said latch plate and having a latch element thereon, said quadrant plate defining a first latch keeper adapted to receive said latch element with said panels in the seat orientation, said quadrant plate defining a second latch keeper adapted to receive said latch element with the panels in the bed orientation.

* * * * *